US011820097B2

(12) United States Patent
Fuhrmann

(10) Patent No.: US 11,820,097 B2
(45) Date of Patent: Nov. 21, 2023

(54) PRESSING METHOD AND APPARATUS

(71) Applicant: HARBURG-FREUDENBERGER MASCHINENBAU GMBH, Hamburg (DE)

(72) Inventor: Martin Fuhrmann, Heidgraben (DE)

(73) Assignee: HARBURG-FREUDENBERGER MASCHINENBAU GMBH, Hamburg (DE)

( * ) Notice: Subject to any disclaimer, the term of this patent is extended or adjusted under 35 U.S.C. 154(b) by 160 days.

(21) Appl. No.: 17/097,381

(22) Filed: Nov. 13, 2020

(65) Prior Publication Data

US 2021/0187889 A1 Jun. 24, 2021

(30) Foreign Application Priority Data

Dec. 19, 2019 (DE) ..... 10 2019 135 051.4

(51) Int. Cl.
*B30B 9/16* (2006.01)
*B30B 9/12* (2006.01)

(52) U.S. Cl.
CPC ..... *B30B 9/16* (2013.01); *B30B 9/121* (2013.01); *B30B 9/122* (2013.01)

(58) Field of Classification Search
CPC .. B30B 9/02; B30B 9/12; B30B 9/121; B30B 9/122; B30B 9/16; B30B 9/166; B30B 9/26; B30B 9/262; B30B 9/267
See application file for complete search history.

(56) References Cited

U.S. PATENT DOCUMENTS 3,092,017 A * 6/1963 French ..... B30B 9/12 100/150
3,518,936 A * 7/1970 Bredeson ..... B30B 9/12 100/98 R
4,289,067 A * 9/1981 Hanak ..... B30B 9/12 100/150
4,401,023 A * 8/1983 Suhr ..... B30B 9/12 100/150

* cited by examiner

*Primary Examiner* — Matthew Katcoff
(74) *Attorney, Agent, or Firm* — LUCAS & MERCANTI, LLP; Klaus P. Stoffel

(57) ABSTRACT

A pressing apparatus having a strainer cage and at least two feeding screws, which are arranged one behind the other in the feeding direction on a common screw shaft, wherein a pressure zone with no screw helix is arranged between the feeding screws. In the region of the pressure zone, the pressing apparatus according to the invention has a plurality of scraper shells, and these provide for improved efficiency of the pressing operation.

6 Claims, 5 Drawing Sheets

PRESSING METHOD AND APPARATUS

CROSS-REFERENCE TO RELATED APPLICATIONS

The present application claims priority of DE 10 2019 135 051.4, filed Dec. 19, 2019, the priority of this application is hereby claimed, and this application is incorporated herein by reference.

BACKGROUND OF THE INVENTION

The invention relates to a pressing apparatus having a strainer cage, in which at least two pressing and feeding screws arranged one behind the other can be rotated on a screw shaft.

The invention also relates to a pressing method in which a pressing material is pressed with the aid of a pressing apparatus.

The prior art discloses various pressing apparatuses for separating free-flowing, liquid or thixotropic constituents from different substances, solids and organic or inorganic materials using pressing operations. In particular for vegetable products, cage-type screw presses are proving successful for separating liquids and, in particular, oil-containing constituents, considerable pressing forces and pressing pressures acting on the pressing material, or on the compressed matter containing the oil-containing constituents, in the pressing chamber of said screw presses.

The pressing chamber, also referred to as the strainer chamber, is geometrically delimited at least to some extent by at least one so-called strainer cage. It is often the case that the strainer cages are designed with a cylindrical or hollow-cylindrical geometry and subdivided into individual cage-bar zones or cage zones for accommodating and/or retaining cage bars.

Cage bars and/or strainer cages of the type mentioned in the introduction are used in the field of apparatuses for pressing free-flowing or liquid substances out of materials or products which have been introduced into the apparatus. It is possible, for example, for liquid substances to be pressed out of animal carcasses, slaughterhouse waste or oil-containing fruits, seeds or plants. The pressing apparatuses are of drum-like design and the cage bars extend in a longitudinal direction of the drum. The substances which are to be processed are also transported in this longitudinal direction. In the region of a drum exit, the residual substances are discharged from the drum interior in a more or less moisture-free state. Transportation through the drum takes place using a pressure-applying screw conveyor.

As the substances are being transported through the strainer cage, the liquids which are contained in the input substances are pressed out by the pressing operation between the boundary surfaces of the screw helixes of the feeding screw and the cage bars. In order to allow the squeezed-out free-flowing constituents to flow out, the cage bars are arranged at gap-like distances relative to one another. In order to ensure optimum progression of the pressing operation, the cross-sectional surface area of the screw helix decreases in size from the inlet in the direction of the outlet.

The main aim of the pressing operation is to provide for the best possible separation of free-flowing and, in particular, oil-containing constituents and solid constituents from the pressing material. A further aim is to achieve the highest possible volume of flow. Moves are made to achieve both aims in optimum fashion by virtue of the machine elements for applying the pressing forces being designed with maximum power and the pressing chamber being made of a suitable geometry.

If the pressing material is fed through a uniformly configured pressing chamber with the aid of just one feeding screw, separation of the liquid and solid constituents of the pressing material is possible only to a certain degree, since some of the pressing material moves within the pressing chamber exclusively in the vicinity of the screw shaft. The liquid constituents of this pressing material in the vicinity of the shaft thus cannot pass out of the pressing chamber through the outer openings of the strainer cage and are discharged from the pressing chamber with the pressing residues which have been separated to some extent from the liquid constituents.

The prior art has already disclosed a plurality of feeding screws being arranged one behind the other on a common screw shaft. The pressing material here is to a certain extent swirled up in the regions, referred to as pressure zones, between the helixes of screws located one behind the other, and therefore pressing material transported on a first screw, in the vicinity of the screw shaft, can pass outwards into the region of the openings of the strainer cage.

It is also already known to make use, for the purposes of improving the efficiency of the separation of the pressing material into liquid and solid constituents, of extensions which are referred to as scrapers and project inwards from the strainer cage in the region of clamping bars, which are used for fixing the cage bars.

SUMMARY OF THE INVENTION

It is an object of the invention to specify a pressing apparatus of the type mentioned in the introduction which is improved in respect of the efficiency of separating liquid and solid constituents of the pressing material.

It is a further object of the invention to specify an improved pressing method of the type mentioned in the introduction.

The features of the pressing apparatus which are disclosed hereinbelow form part of the invention both individually and in all feasible combinations.

The pressing apparatus according to the invention has a pressing chamber, which is delimited by a hollow-cylindrical strainer cage and in which at least two feeding screws can be rotated one behind the other on a common screw shaft.

The strainer cage has openings through which a liquid which has been pressed out of the pressing material can be discharged out of the pressing chamber.

In one embodiment of the invention, the strainer cage is retained in a cage frame.

In one embodiment of the invention, a respective pressure zone is arranged between the feeding screws of the pressing apparatus. The pressure zone is free of screw helixes of the feeding screws.

In one embodiment of the invention, a cone element is arranged on the screw shaft in the region of the pressure zone between the respectively adjacent feeding screws, wherein the diameter of the cone increases in the feeding direction.

In one embodiment of the invention, the feeding screws have a hollow-cylindrical main body, which is seated firmly on the screw shaft. The lateral surface of the respective hollow cylinder is delimited by a helically encircling wall element and/or the screw flights of the screw helix of the respective feeding screw.

In one embodiment of the invention, the diameter of the hollow-cylindrical main body of two successive feeding screws is greater for the second feeding screw than for the first feeding screw, the second being arranged downstream of the first feeding screw in the feeding direction.

In one embodiment of the invention, it is also the case that the cone element, which is arranged between two feeding screws, has, at its ends, diameters which are adapted to the main body of the respectively directly adjacent feeding screw.

In a preferred embodiment of the invention, the cone element is defined in the form of a truncated circular cone.

According to the invention, a plurality of scraper shells are arranged in the at least one pressure zone of the pressing apparatus.

Each of the scraper shells has a nose-like extension which, in an installed state of a scraper shell, projects from a base strip of the scraper shell inwards, from the strainer cage, into the pressing chamber.

In one embodiment of the invention, the scraper shells are distributed uniformly along the circumference of the strainer cage in the pressure zone.

In one embodiment of the invention, the strainer cage has a plurality of cage bars, which are arranged one beside the other in cage zones and are spaced apart from one another by a certain distance, and therefore a liquid which has been pressed out of the pressing material can be discharged out of the pressing chamber through the gaps located between the cage bars.

In a preferred embodiment of the invention, the scraper shells are arranged in the cage zones between the cage bars of the strainer cage in the region of a pressure zone.

If the strainer cage has been split into two strainer-cage halves, then a strainer-cage portion has two cage zones, in which the cage bars are arranged one beside the other. The cage zones of a strainer-cage portion are delimited by the clamping bars and/or scrapers, which fix the cage bars of the respective cage zone in the associated strainer-cage segment. For each cage zone, according to the invention, at least one scraper shell is arranged between the cage bars of the respective cage zone.

In a further embodiment of the invention, two scraper shells are arranged between the cage bars of the respective cage zone.

In a further embodiment of the invention, three scraper shells are arranged between the cage bars of the respective cage zone.

In one embodiment of the invention, the scraper shells are of the same length as the cage bars inserted in the respective cage zone.

In one embodiment of the invention, the base strip of a scraper shell is designed to be wider than the cage bars inserted in the respective cage zone.

In one embodiment of the invention, the width of the scraper shell is selected to be large enough to counteract lateral tilting or to prevent the same. At the same time, the internal pressure during the pressing operation also ensures that the scraper shell is pressed onto its bearing surface in the strainer cage. The scraper shell, however, must not be too wide, since there still has to be sufficient space for cage bars with gaps in the cage zone as a whole, in order to ensure sufficient separation of the solids and liquid(s) of the pressing material during the pressing operation.

In one embodiment of the invention, the shape of the base strip of a scraper shell is adapted to the contour of the strainer cage.

In one embodiment of the invention, the base strip of a scraper shell, for this purpose, is curved in the transverse direction, and therefore the outer side of the scraper shell realizes a segment of a cylinder surface or the base strip realizes a hollow-cylinder segment.

In a preferred embodiment of the invention, the scraper shells are manufactured from a hardened metal.

In one embodiment of the invention, the extension of a scraper shell is designed in the manner of a crosspiece.

In a preferred embodiment of the invention, the contour of the extension of the scraper shell is adapted to the contour of the feed device in the region of the pressure zone.

In particular, the height of the extension, in terms of how far the extension projects into the pressing chamber, in the longitudinal direction of the extension is adapted to the contour of the feed device. The longitudinal direction of the extension here is oriented in the feeding direction of the screw conveyor.

In a preferred embodiment, the height of the extension decreases in the longitudinal direction.

In an advantageous embodiment of the invention, the length of the extension is defined by the length of the respective pressure zone. Depending on how a cage-type press is embodied, the pressure zone can vary in its length, diameter (accordingly, distance in relation to the interior of the strainer cage) and contour. The extensions here cannot be any longer than the overall length of the respective pressure zone.

In one embodiment of the invention, the width of the extension is dependent on the desired effect to be achieved in terms of the material mixing or swirling when the pressing material comes into contact with said end surface of the extension in the flow direction.

The scraper shells, which are arranged in the at least one pressure zone, can achieve a number of effects which have a positive influence on the efficiency of the pressing apparatus in respect of the separation of liquid and solid constituents of the pressing material.

On the one hand, the pressing material can be guided with the aid of the scraper shells, and this can avoid the situation where the material rotates along in the pressing apparatus. This can ensure that material is drawn continuously into the pressing apparatus and/or the material is transported continuously in the pressing apparatus.

Furthermore, the scraper shells can help not just to stabilize, but additionally to hold back, the pressing material. Material can be accumulated by the large surface area as said material strikes against the scraper shell or the scraper shells, as a result of which the pressing pressure of the pressing apparatus can be increased. The material throughput nevertheless remains the same; it is only the power consumption of the screw motor which increases, to give the same output.

On the other hand, improved swirling action of the pressing material can be achieved with the aid of the scraper shells, which are arranged between the end of the helix of a first screw and the start of the helix of a second screw. The accumulation of material which can be generated can be broken up with the aid of the respective screw helixes, and therefore the material can be forced to change position.

In one embodiment, a pressing method according to the invention is characterized in that the pressing material is fed into the region of a pressure zone with the aid of a first feeding screw, and in that, in the pressure zone, the pressing material is mixed and/or guided and/or held with the aid of a plurality of scraper shells, and in that the pressing material is fed onwards in the feeding direction downstream of the pressure zone with the aid of a second feeding screw.

In a preferred embodiment of a pressing method according to the invention, use is made of a pressing apparatus according to the invention.

The various features of novelty which characterize the invention are pointed out with particularity in the claims annexed to and forming a part of the disclosure. For a better understanding of the invention, its operating advantages, specific objects attained by its use, reference should be had to the drawings and descriptive matter in which there are illustrated and described preferred embodiments of the invention.

DETAILED DESCRIPTION OF THE INVENTION

Figure 1:
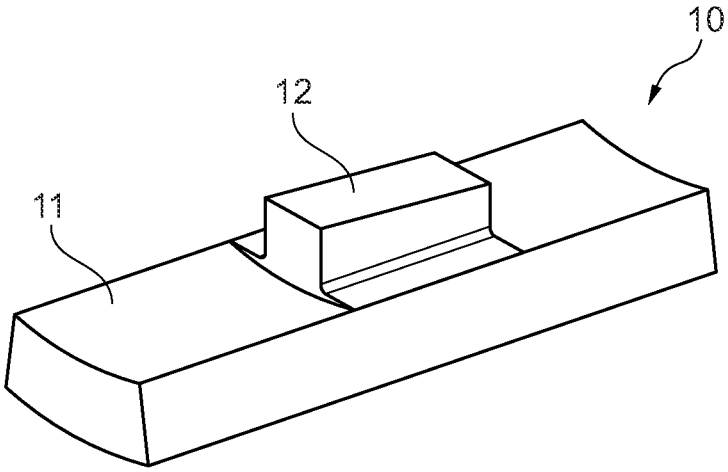
FIG. 1: shows a perspective illustration of a scraper shell of a pressing apparatus according to the invention.

FIG. 1 shows a perspective illustration of a scraper shell (10) of a pressing apparatus (1) according to the invention. The scraper shell (10) has a base strip (11), which is adapted to the contour of a strainer cage (2). For this purpose, the base strip (11) of the scraper shell (10) is curved in the transverse direction, and therefore it is designed for example in the form of a hollow-cylinder segment. An extension (12) is arranged approximately centrally on the inner side of the scraper shell (10) and projects out of the base strip (11). The extension (12) is designed in the manner of a crosspiece and the height of the extension (12) decreases continuously in one direction.

Figure 2:
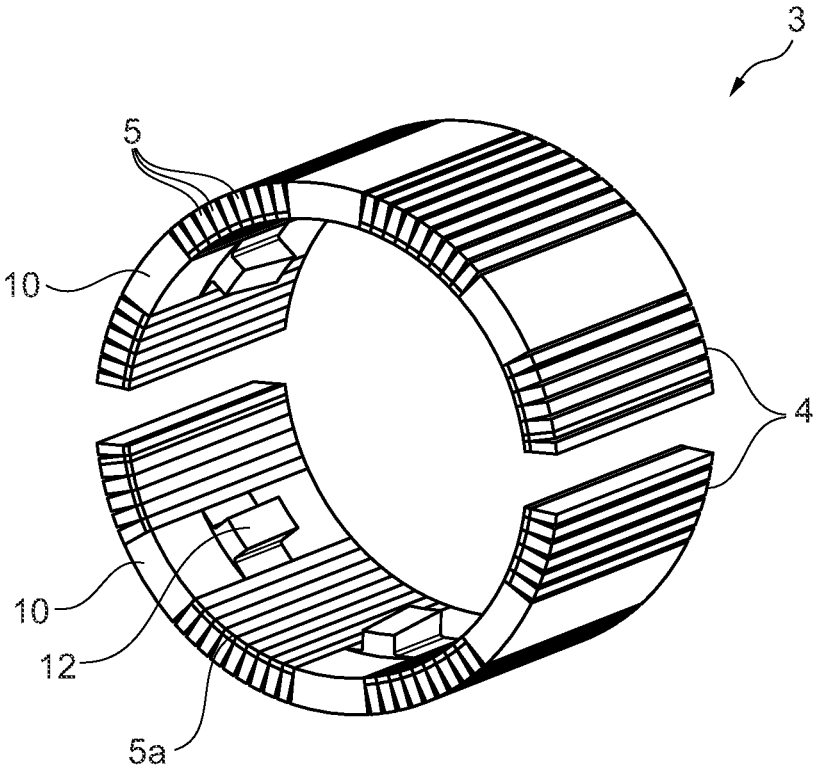
FIG. 2: shows a perspective view of a cage zone according to the invention which comprises scraper shells.

FIG. 2 shows a perspective illustration of the cage zone of a strainer-cage portion (3) of a pressing apparatus (1) according to the invention. The cage zone has been divided into two cage-zone segments, which are each formed from a plurality of cage bars (5) arranged one beside the other. Gaps are formed in each case between the cage bars (5). Each of the cage-zone segments contains in each case three scraper shells (10), which are spaced apart uniformly from one another in the respective cage-zone segment. The extensions (12) of the scraper shells (10) project inward from the cage zone, which is formed by the cage bars (5) and the base strips (11) of the scraper shells (10), into the strainer-cage portion (3), which is formed from the cage-zone segments and the cage frame (6) (not shown in this illustration). The cage bars (5) have reinforcement plating (5*a*) on their inner side for wear-reducing purposes.

Figure 3:
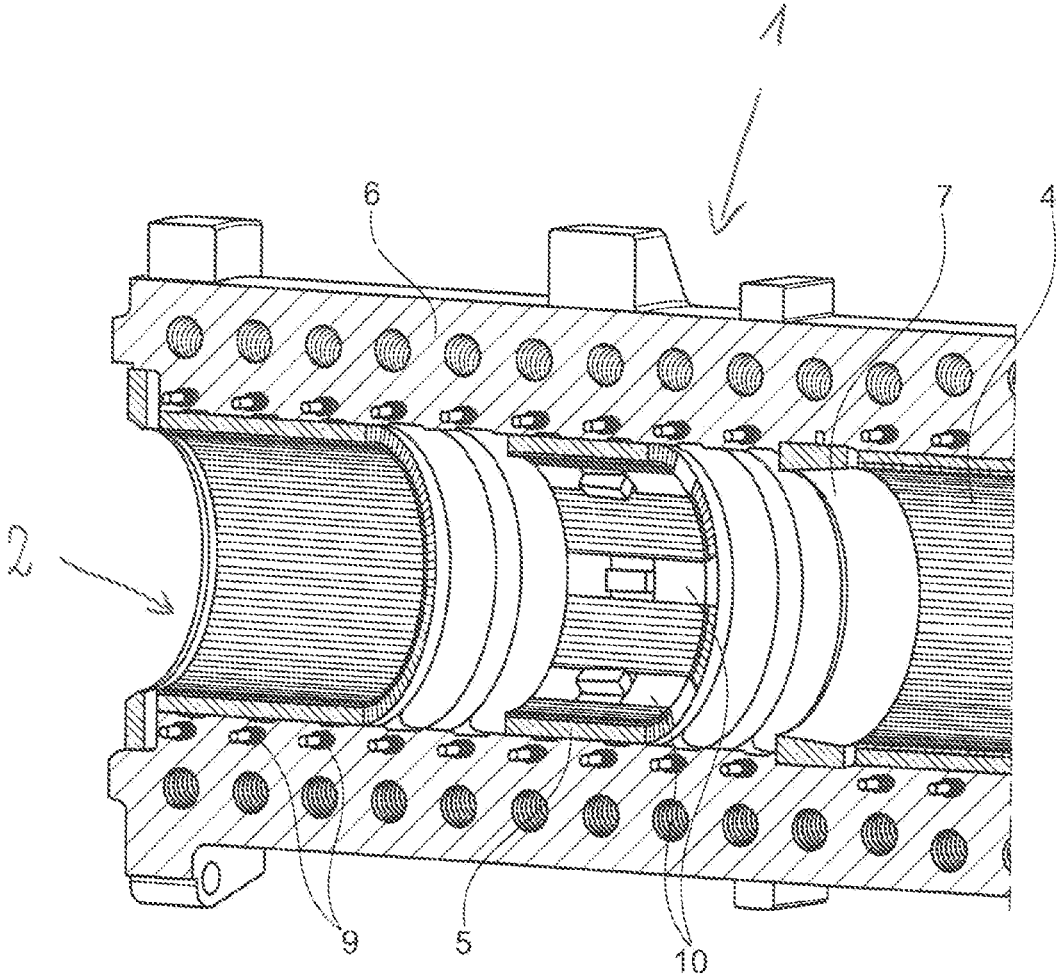
FIG. 3: shows a perspective view of a detail of a pressing apparatus according to the invention in the region of one strainer-cage half.

FIG. 3 illustrates a perspective view of a detail of an embodiment of a pressing apparatus (1) according to the invention in the region of the open, and only partially fitted-out, strainer cage (2). The strainer-cage segments (4) illustrated are arranged in a cage frame (6). Arranged alongside that strainer-cage segment (4) which is arranged on the right-hand side of the cage frame (6) is a split cage ring (7), which compensates for a change in diameter of the cage frame (6), and therefore, in the feeding direction, there is a continuous reduction in diameter of the pressing chambers in the region of the split cage ring (7). A strainer-cage segment (4) having three scraper shells (10) inserted into the cage zone is illustrated approximately in the centre of the cage frame (6). Arranged alongside the strainer-cage segments (4), in the cage frame (6), are fastening means (9) for fastening clamping bars (not illustrated) for fixing the cage bars (5) and/or scraper shells (10) in the respective strainer-cage segment (4).

Figure 4:
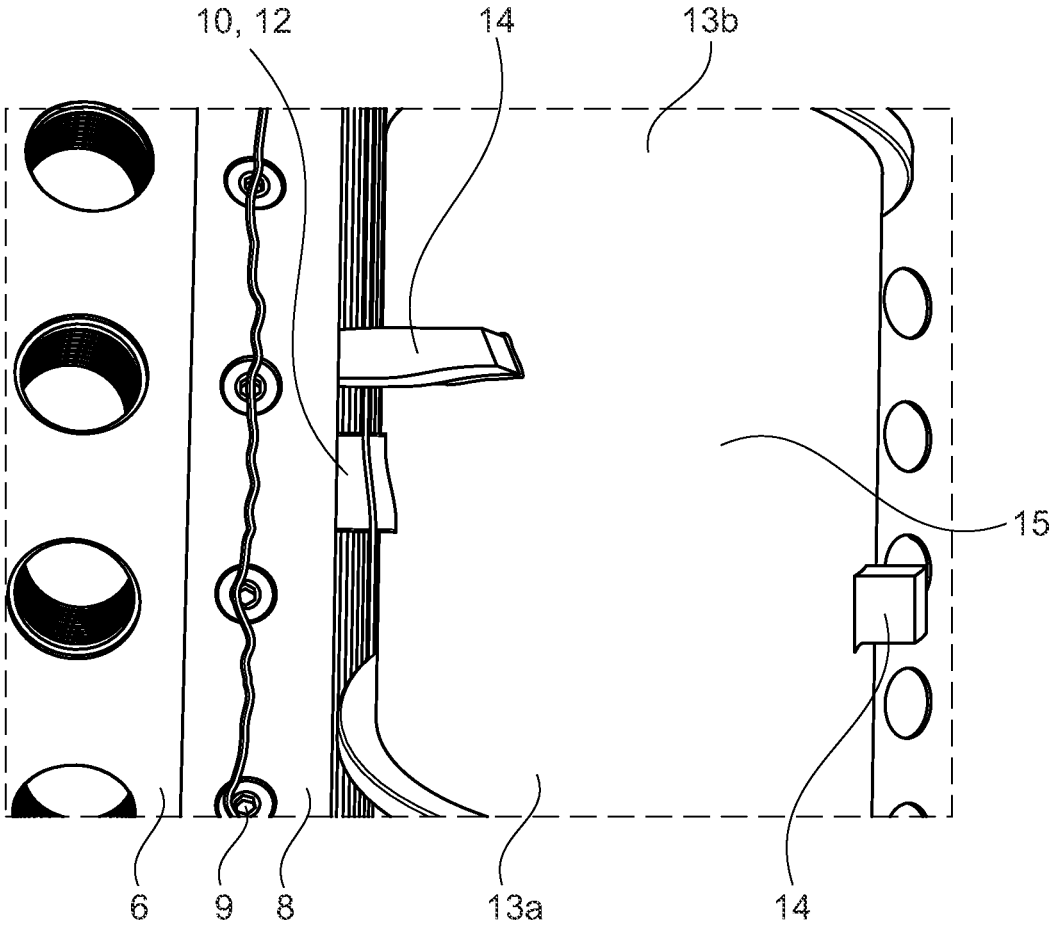
FIG. 4: shows a view of a detail of an embodiment of a pressing apparatus according to the invention with its strainer cage open, in the region of a scraper shell.

FIG. 4 shows a view of a detail of an embodiment of a pressing apparatus (1) according to the invention with its strainer cage (2) open, in the region of a scraper shell (10). The strainer cage (2) contains two feeding screws (13*a*, 13*b*), which are arranged one behind the other on a common screw shaft. A cone element (15) is arranged between the first feeding screw (13*a*) and the second feeding screw (13*b*). The feeding screws (13*a*, 13*b*) each have a hollow-cylindrical main body, on which in each case at least one screw flight (14) is arranged. The at least one screw flight (14) delimits the screw helix of the respective feeding screw (13*a*, 13*b*). The main body of the first feeding screw (13*a*) has a smaller diameter than the main body of the second feeding screw (13*b*). The cone element (15) realizes an approximately continuous transition from the diameter of the main body of the first feeding screw (13*a*) to the diameter of the main body of the second feeding screw (13*b*). The screw flight (14), and therefore the screw helix, of the first feeding screw (13*a*) terminates at a small distance upstream of the extension (12) of the scraper shell (10), as seen in the feeding direction. There is no screw flight (14) arranged in the region of the cone element (15). The screw flight (14), and therefore the screw helix, of the second feeding screw (13*b*) begins at a distance downstream of the end of the extension (12) of the scraper shell (10), as seen in the feeding direction.

The cage bars (5) and scraper shells (10) of the strainer-cage segment (4) are fixed in the strainer-cage segment (4) with the aid of clamping bars (8).

A pressure region of the pressing apparatus (1), the scraper shells (10) also being arranged in said pressure region, is formed in the region of the cone element (15).

Figure 5:
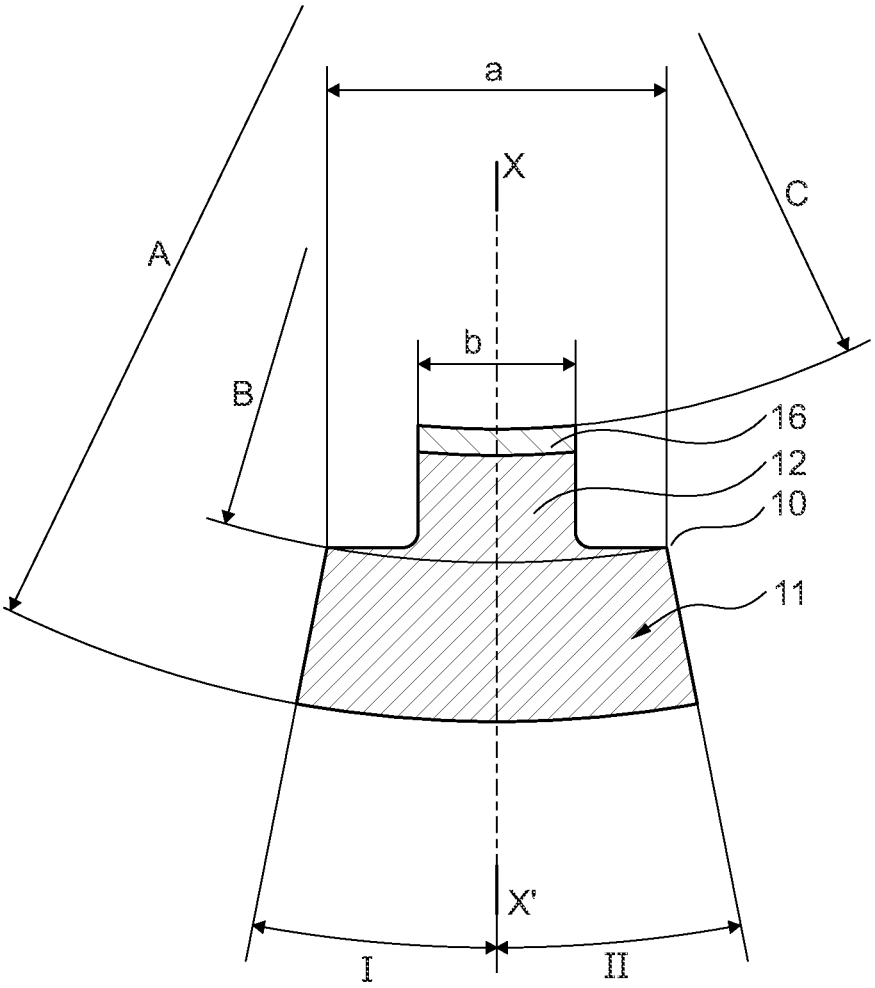
FIG. 5: shows a cross section of an embodiment of a scraper shell according to the invention.

FIG. 5 illustrates a cross section of an embodiment of a scraper shell (10) according to the invention. The underside and the upper side of the base strip (11) of the scraper shell (10) are curved along segments of a circle. The underside of the base strip (11) of the scraper shell (10) is curved along a segment of a first circle, which has the diameter A, and the upper side of the base strip (11) of the scraper shell (10) is curved along a segment of a second circle, which has the diameter B. It is also the case that the upper side of the extension (12) of the scraper shell (10) is curved along a segment of a circle, use being made here of a segment of a third circle, which has the diameter C. As seen three-dimensionally with the corresponding lengths, the aforementioned sides are each designed in the manner of a segment of a cylinder wall.

The scraper shell (10) has a width a in the region of the upper side of the base strip (11) and a width b in the region of the upper side of the extension (12).

In relation to the centre axis X-X', the base strip (11) of the scraper shell (10) extends, as seen in a first lateral direction along the segment of the first circle, in an angle range I and, in the opposite, second lateral direction, in an angle range II.

In one embodiment of the invention, the angle range I and the angle range II differ from one another. In one embodiment of the invention, one angle range is greater than the other angle range.

The scraper shell (10) has reinforcement plating (16) on the upper side of the extension (12).

Figure 6:
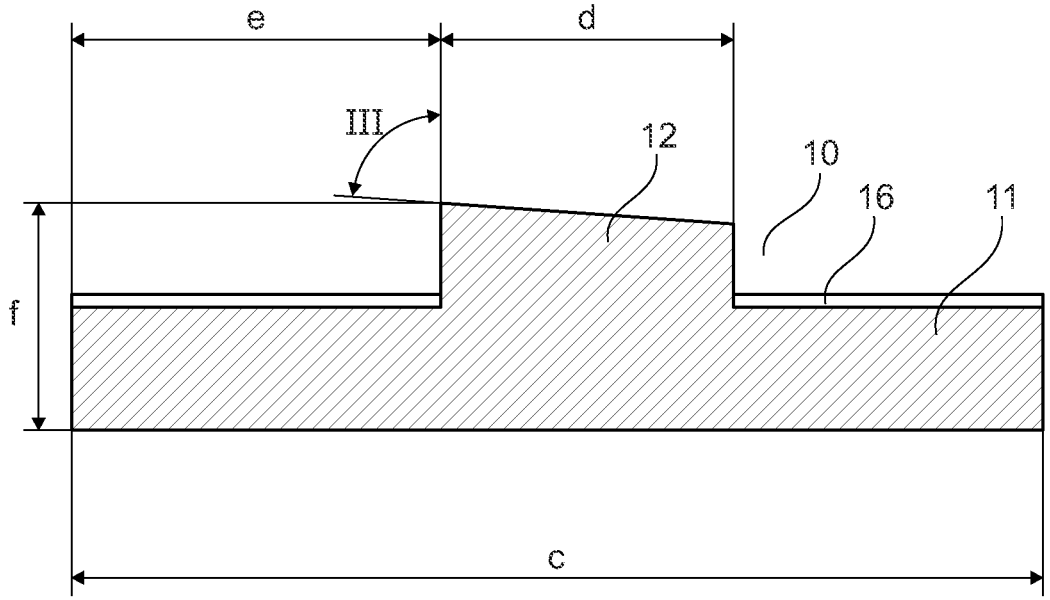
FIG. 6: shows a section taken in the longitudinal direction of an embodiment of a scraper shell according to the invention.

FIG. 6 shows a section taken in the longitudinal direction of a scraper shell (10) according to the invention. The scraper shell (10) has the length c. On the upper side of the base strip (11), reinforcement plating (16) is arranged around the extension (12). The extension (12) has the length d and is arranged at the distance e from a first end of the scraper shell (10). The extension (12) has a height which decreases in the longitudinal direction of the scraper shell (10). The upper side of the extension (12) here is arranged at an angle III in relation to the continuation of the side wall of the extension (12). At the highest point, the scraper shell (10) has the height f.

The absolute dimensioning of the individual parameters of the scraper shells (10) depends on the design of the strainer cage as a whole. In particular, the desired number of gaps, and the width thereof, the throughput of pressing material through the press as a whole, the degree to which the liquid constituents are pressed out of the pressing material, and the amount of energy which is appropriate to use for the pressing operation, all play a role.

The following dimensions of embodiments of scraper shells (10) according to the invention relate not to individual exemplary embodiments amongst those mentioned above, but to all of the embodiments of the scraper shell (10) according to the invention.

In one embodiment of the invention, the width a of the scraper shell (10) is 30 mm to 80 mm. In a preferred embodiment, this width is 45 mm to 65 mm.

In one embodiment of the invention, the height f of the scraper shell (10) is 30 mm to 60 mm. In a preferred embodiment, this height is 40 mm to 50 mm.

In one embodiment of the invention, the width b of the extension (12) of the scraper shell (10) is 10 mm to 40 mm. In a preferred embodiment of the invention, this width is 20 mm to 30 mm.

In one embodiment of the invention, the length d of the extension (12) of the scraper shell (10) is 40 mm to 80 mm. In a preferred embodiment, this length is 50 mm to 70 mm.

In one embodiment of the invention, the angle range I and the angle range II are each between 5° and 15°.

The angle III is adapted to the contour of the cone segment in the respective pressure region of the pressing apparatus. In one embodiment of the invention, the angle III is 80° to 89°. In a preferred embodiment of the invention, the angle III is 84° to 88°.

While specific embodiments of the invention have been shown and described in detail to illustrate the inventive principles, it will be understood that the invention may be embodied otherwise without departing from such principles.

I claim:

1. A pressing apparatus comprising: a pressing chamber delimited by at least one strainer cage; at least two feeding screws arranged behind one another in a longitudinal transport direction of the feeding screws on a common screw shaft, each of the feeding screws having a screw helix, wherein a respective pressure zone is arranged between the feeding screws; and, in at least one of the pressure zones, at least one scraper shell arranged between cage bars of a cage zone in a cage zone, said scraper shell having at least one extension that projects into the pressing chamber, wherein the scraper shells have a base strip and the at least one extension projects out of the base strip, wherein the base strip has a curved contour adapted to a shape of the strainer cage, wherein the base strip is formed as a hollow-cylindrical segment that is curved in a direction transverse to the transport direction, wherein the extension is arranged in the cage zone, wherein the at least one pressure zone is free of screw helixes, wherein the extension has a height that decreases opposite to the transport direction so as to provide a recess with an edge, wherein the curved contour of the base strip is arranged in a region of a surface of the base strip directed to an inner surface of the strainer cage, and wherein the edge of the recess extends perpendicular to the inner surface of the strainer cage.

2. The pressing apparatus according to claim 1, wherein at least two scraper shells are arranged in the cage zone or the cage zones of a respective segment of the strainer-cage.

3. The pressing apparatus according to claim 2, wherein the scraper shells are distributed uniformly in the respective strainer-cage segment.

4. The pressing apparatus according to claim 1, wherein the extension of at least one of the scraper shells has a contour adapted to a shape of the feeding screw in the respective strainer-cage segment.

5. The pressing apparatus according to claim 1, wherein the extension of at least one of the scraper shells has a height that increases or decreases in a longitudinal direction.

6. A pressing method comprising the steps of: feeding a pressing material into a region of a pressure zone using a first feeding screw; mixing and/or guiding and/or holding the pressing material in the pressure zone using a plurality of scraper shells; and feeding the pressing material onwards in a feeding direction downstream of the pressure zone using a second feeding screw, including carrying out the pressing method using a pressing apparatus comprising: a pressing chamber delimited by at least one strainer cage; at least two feeding screws arranged behind one another on a common screw shaft in a longitudinal direction of the feeding screws, each of the feeding screws having a screw helix, wherein a respective pressure zone is arranged between the feeding screws; and, in at least one of the pressure zones, at least one scraper shell arranged between cage bars of a cage zone in the cage zone, said scraper shell having at least one extension that projects into the pressing chamber, wherein the extension has a height that decreases opposite to the transport direction so as to provide a recess with an edge, wherein a base strip of the scraper shell has a curved contour in a direction transverse to the transport direction, and wherein the extension is arranged in the cage zone, wherein the curved contour of the base strip is arranged in a region of a surface of the base strip directed to an inner surface of the strainer cage, and wherein the edge of the recess extends perpendicular to the inner surface of the strainer cage.

* * * * *